US005886463A

United States Patent [19]

Damen et al.

[11] Patent Number: 5,886,463

[45] Date of Patent: Mar. 23, 1999

[54] THIN-TYPE DISPLAY DEVICE WITH ONE-PIECE REAR WALL

[75] Inventors: Johannes H.M. Damen; Hermanus N. Tuin; Johannes T.H. Leijten; Cornelus H.M. Van Bommel; Wilhelmus N.M. Selten; Martinus G.F.C. Sanders; Franciscus M.H. Van Laarhoven; Marcel Niestadt, all of Eindhoven, Netherlands

[73] Assignee: U.S. Philips Corporation, New York, N.Y.

[21] Appl. No.: 792,318

[22] Filed: Jan. 31, 1997

[30] Foreign Application Priority Data

Feb. 9, 1996 [EP] European Pat. Off. ..... 96200303

[51] Int. Cl.[6] ..... H01J 31/12; H01J 29/86

[52] U.S. Cl. ..... 313/422; 313/495; 313/496; 313/477 R; 313/480

[58] Field of Search ..... 313/422, 495, 313/496, 477 R, 480, 481

[56] References Cited

U.S. PATENT DOCUMENTS

| | | | |
|---|---|---|---|
| 4,613,399 | 9/1986 | Kobale et al. | 156/634 |
| 5,150,005 | 9/1992 | Yokono | 313/495 |
| 5,347,199 | 9/1994 | Van Gorkom et al. | 315/169.1 |
| 5,404,072 | 4/1995 | Flanary et al. | 313/477 R |
| 5,508,590 | 4/1996 | Sampayan et al. | 315/169.1 |

FOREIGN PATENT DOCUMENTS

| | | | |
|---|---|---|---|
| 0369468 | 5/1990 | European Pat. Off. . | |
| 0400751 | 12/1990 | European Pat. Off. . | |
| 3-263741 | 11/1991 | Japan | 313/477 R |
| 9429893 | 12/1994 | WIPO . | |

OTHER PUBLICATIONS

Procedures in Experimental Physics by John Strong, Ph.D. Prentice–Hall, Inc. pp. 4–5.

*Primary Examiner*—Nimeshkumar D. Patel
*Attorney, Agent, or Firm*—John C. Fox

[57] ABSTRACT

The thin-type display device (1) has a transparent front wall (3), which is provided with a display screen, and a rear wall (24) which extends parallel to said front wall (3), and said display device comprises at least an electron source and a duct structure. The display device (1) is characterized in that the rear wall (24) and walls (22, 22', 22") of the ducts of the duct structure are manufactured in a single piece. Preferably, the walls (22, 22', 22") of the ducts widen in the direction of the rear wall (24), with the angle, which opposing faces of the walls (22, 22', 22") of the ducts make with each other, ranging from 1° to 30°. Preferably, the rear wall (24) further comprises at least an upright side wall (32), which is integral with the rear wall (24). Preferably, the walls (22, 22', 22") are made from a glass having a temperature interval between the operating temperature and the softening temperature of less than 420°, perferably less than 360°, and the duct structure and the side walls (32) can be pressed in one process step.

14 Claims, 4 Drawing Sheets

THIN-TYPE DISPLAY DEVICE WITH ONE-PIECE REAR WALL

BACKGROUND OF THE INVENTION

The invention relates to a thin-type display device which comprises a transparent front wall which is provided with a display screen having a pattern of pixels, and a rear wall which extends parallel to said front wall, which display device includes at least an electron source and a duct structure, which cooperates with said electron source and extends substantially parallel to the front wall, and which comprises walls which are transverse to the rear wall, said rear wall and the walls forming the ducts of the duct structure.

Thin-type display devices are used for displaying monochromatic or colour images in vacuum tubes, plasma displays and plasma-addressed liquid-crystal display devices (PALC display devices).

A display device of the type mentioned in the opening paragraph is disclosed in United States Patent document U.S. Pat. No. 5,347,199 (PHN 13.197), in which a description is given of a display device which employs (multiple or ribbon-shaped) electron currents which initially extend substantially parallel to the plane of the front wall and, finally, are constrained to move in a direction transverse to the display screen so as to address the desired (luminescent) pixels of the display screen, either directly or by means of, for example, an addressing system. In the known display device, the ducts of the duct structure comprise so-called electron-propagation means which cooperate with the electron source to transport emitted electrons through vacuum. The electron currents, which are to be guided by the electron-propagation means, can be generated by means of an electron source or by means of an arrangement of a number of electron sources which are parallel to (an edge of) the front wall. The electron currents generated by the electron source(s) are guided by means of the propagation means (beam-guiding means) over at least a part of the height (or width) of the display device in the direction of one of the edges of the display screen. To make it possible for the electron current to leave the electron-propagation means in desired (successive) places, a beam-guiding means can be provided with a row of apertures with electrodes which can be energized either to withdraw or not to withdraw electron currents from the propagation means at the location of an aperture.

In plasma displays, electrons are generated in the ducts of the duct structure, which electrons address desired (luminescent) pixels of the display screen, either directly or by means of, for example, an addressing system. In plasma-addressed LCDs (PALC displays), a plasma having a relatively low energy level is generated in the ducts of the duct structure, which plasma converts the (plasma) duct of an (electrically neutral) insulator into a conductor. If a suitable voltage is applied to an electrode in a corresponding LCD element, the plasma provides for the conduction which is necessary to set the voltage across the LC element and hence control the transparency of the element.

A disadvantage of the known display device is that, during the manufacture of the duct structure, the interspace between the walls of the ducts, and hence the width of the ducts extending (transverse) to the rear wall is not constant. As a result, differences in (beam) intensity between adjacent ducts develop, which give rise to annoying streaks in the image displayed on the display screen by the pixels.

OBJECTS AND SUMMARY OF THE INVENTION

It is an object of the invention to provide a display device in which intensity differences between adjacent ducts of the duct structure are minimized.

To this end, the display device in accordance with the invention is characterized in that the rear wall and the walls of the ducts of the duct structure are constructed in one piece. The expression "in one piece" is to be understood to mean herein that the rear wall and the walls are manufactured from a single, solid piece of one material (for example glass, ceramics or synthetic resin) and that the assembly of rear wall and walls of the ducts of the duct structure is not obtained by means of a connection technique.

The inventors have recognized that the walls of the ducts of the duct structure, which extend transverse to the rear wall, should not be individually manufactured, positioned on the rear wall and subsequently connected to the rear wall by means of a connection technique (for example by means of an adhesive or by the so-called "fritting"), because this would be unfavorable. A further drawback of walls which are connected to the rear wall by means of a connection technique is that stresses can develop in these connections, while, in addition, undesirable properties of the material used to connect the walls of the ducts to the rear wall, may adversely affect the quality (for example the service life) of the display device.

By manufacturing the rear wall and the walls of the ducts in a single piece, an accurate positioning of the walls relative to each other is obtained. By virtue thereof, a variation in the interspace between the walls of the ducts is effectively precluded. If walls are accurately provided, the width of the individual ducts of the duct structure are substantially identical and, consequently, differences in (beam) intensity between two (adjacent) ducts are precluded, so that annoying streaks in the image displayed on the display screen by the pixels are precluded or reduced.

A further advantage obtained by manufacturing the rear wall and the walls of the ducts of the duct structure in a single piece is that the number of parts of the display device is reduced substantially. Instead of individually manufacturing many hundred to several thousand (thin) walls, the number depends on the dimensions of the display device, (for example by cutting the walls from a suitable plate material), the ducts can now be provided in a suitable substrate material, thereby forming the rear wall and the walls. The walls are provided in the substrate in one operation whenever possible.

Suitable methods of manufacturing the rear wall and the walls of the ducts of the duct structure in a single piece include (selective) etching or sand blasting of transport ducts in a substrate on which, during the manufacture, for example a mask (such as a photoresist or a suitable (ductile) layer) is provided. In an alternative method, the transport ducts can be ground into a substrate, either by successively grinding adjacent ducts of the desired depth into a substrate or by simultaneously providing a number of ducts in a substrate by means of, for example, a number of parallel, juxtaposed (rotating) saw blades. In a further method of manufacturing the rear wall and the walls of the electron-transport ducts in a single piece, the ducts are pressed into a suitable substrate material. On the one hand, "pressing" is to be understood to mean herein that a profiled structure is formed in a quantity of glass, which may be unformed or preformed, by a movement of a mould. On the other hand, "pressing" refers to the process in which a pre-formed (glass) plate is provided with a profiled structure by a (horizontal) movement of a mould (for example rolling).

An embodiment of the display device in accordance with the invention is characterized in that the walls of the ducts of the duct structure widen in the direction of the rear wall, the angle which opposing faces of the walls of the ducts make with a normal, which extends perpendicularly to the rear wall, ranging from 1° to 30°.

A more robust construction of the duct structure and hence of the display device is obtained if the walls of the ducts of the duct structure widen in the direction of the rear wall. The angle, which opposing (side) faces of the walls of the ducts make with the rear wall, is measured at the location of the portion of the walls of the ducts of the duct structure which is (most) remote from the rear wall. An upper limit of 30° is maintained to preclude that the ducts of the duct structure become too narrow in the vicinity of the rear wall. If the ducts of the duct structure are very shallow, for example with a depth (measured relative to the rear wall) of less than 1 mm, the angle which the walls make with the rear wall can be chosen to be larger than 30° (for example 60°).

The widening of the walls of the ducts in the direction of the rear wall can take place in accordance with a straight line or a curved line. In the first case, the walls of the ducts form rectangular faces which make the same angle everywhere with the rear wall. If the widening takes place in accordance with a curved line, the angle made by the walls relative to the rear wall increases gradually in the direction of the rear wall.

In a particularly suitable method of manufacturing the rear wall and the walls of the ducts of the duct structure in a single piece, and in which the walls of the ducts of the duct structure widen in the direction of the rear wall, said ducts are pressed in a suitable substrate material. The desired angle, which opposing faces of the walls of the ducts make with the rear wall, can be formed in the substrate in a single pressing step by suitably choosing the shape of the pressing member.

An embodiment of the display device in accordance with the invention is characterized in that the angle ranges from 3° to 10°. If the opposing faces of the walls make a relatively small angle (≦10°) with the rear wall, the width of the ducts of the duct structure remains reasonably large in the vicinity of the rear wall. The lower limit of the angle (≧3°) leads to a substantial increase in strength of the construction.

A preferred embodiment of the display device in accordance with the invention is characterized in that the depth of the ducts of the duct structure, measured in a direction perpendicular to the rear wall, ranges from 0.1 to 10 mm. Relatively shallow ducts in the duct structure (0.1 mm≦depth≦2 mm) are used, in particular, in plasma displays and plasma-addressed liquid-crystal display devices, while relatively deeper ducts in the duct structure (2 mm≦depth≦10 mm) are used, in particular, in thin-type vacuum tubes.

A further embodiment of the display device in accordance with the invention is characterized in that the rear wall further comprises at least an upright side wall to obtain a vacuum-tight connection between the front wall and the rear wall. The expression "upright side wall" can mean that one (or more) of the (four) side walls of the display device is (or are) integral with the rear wall or that the rear wall is integral with one upright wall, which extends (all round) at the corners of the display device.

In the manufacture of the known display device, so-called spacer strips are arranged near the edge of the rear wall to connect said rear wall to the front wall, said front wall being positioned on the spacer strips, which are subsequently connected to the front wall, the rear wall and, near the corners of the display device, to each other by means of a connection technique (for example by means of adhesives or by so-called "fritting"). By manufacturing the rear wall, the walls of the ducts of the duct structure and one or more upright side walls in a single piece, a further simplification of the manufacturing process of the display device is achieved.

Preferably, the side wall is further provided with an upright edge on the inside of which the front wall is positioned. By virtue thereof, the positioning of the front wall and its connection to the rear wall via the side walls in a vacuum-tight manner is simplified further. If necessary, the shape of the upright edge can be chosen to be such (for example by providing the upright edge with a horizontal protuberance) that the front wall is (partly) enclosed by the upright edge.

A further embodiment of the display device in accordance with the invention is characterized in that the walls of the ducts of the duct structure are made from a glass having a temperature interval of less than 420°, perferably less than 360°C., between the operating temperature and the softening temperature. Preferably, the rear wall and the side walls of the display device are made of the same material as the walls of the ducts of the duct structure.

In general, the viscosity $\eta$ of a glass at the melting temperature $\eta=10^2$ dPa.s (0.1 Pa.s=1 dPa.s corresponds to 1 poise). At the so-called operating temperature of the glass, at which most shaping processes, such as bending, blowing, drawing, pressing and casting, take place, the viscosity of the glass $\eta=10^4$ dPa.s. At the so-called "American" softening temperature of the glass, at which the glass products deform within a very short period of time (for example a few seconds) under the influence of their own weight, the viscosity of the glass $\eta=10^{7.6}$ dPa.s. If this range is relatively small (a temperature interval of approximately 150° to approximately 250° C.) the glass is referred to as short glass, if this range is large (larger than approximately 300° C.), the glass is referred to as long glass.

If, in the manufacture of the display device, the rear wall and the walls of the ducts of the duct structure are manufactured in a single piece, and if use is made of a pressing process, it is desirable that the viscosity $\eta$ of the glass used ranges between $10^4$ dPa.s and $10^{7.6}$ dPa.s. In this operating range between, respectively, the operating temperature and the softening temperature of the glass, also the side walls and the walls of the ducts of the duct structure can be formed simultaneously (i.e. in a single pressing step). Preferably, an operating temperature of the glass is chosen which is above 1,050° C. A further preferred operating temperature of the glass is chosen above 920° C.

These and other aspects of the invention will be apparent from and elucidated with reference to the embodiments described hereinafter.

BRIEF DESCRIPTION OF THE DRAWINGS

In the drawings.

The Figures are purely schematic and not drawn to scale. In particular for clarity, some dimensions are strongly exaggerated. In the Figures, like reference numerals refer to like parts whenever possible.

DESCRIPTION OF THE PREFERRED EMBODIMENTS

Figure 1A:
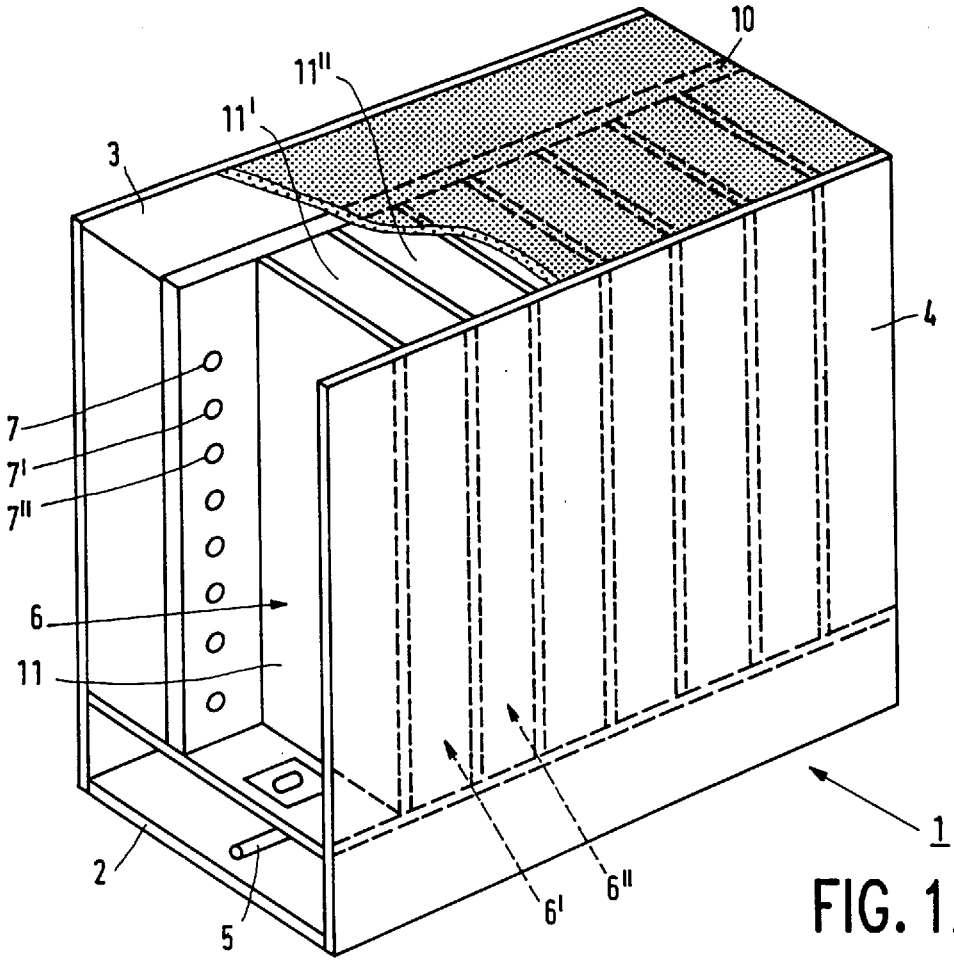
FIG. 1A is a schematic, perspective view, partly broken away, of a part of a construction of a thin-type display device.

FIG. 1A is a schematic, perspective view, partly broken away, of a part of a construction of a thin-type display device 1. The invention is important, in particular, for this kind of thin-type display devices. The display device comprises a front wall (window) 3 and an oppositely located rear wall 4, which is parallel to said front wall. A display screen which includes a (regular) pattern of pixels luminescing, respectively, in red, green and blue is provided on the inner surface of the front wall 3. Near an upright side wall 2, which interconnects the front wall 3 and the rear wall 4, at least an electron source 5 is arranged. This electron source 5 comprises, for example, a cathode arrangement which includes one or more line cathodes or a large number of separate electrodes. In this example, above the electron source 5, there is arranged a number of electron-propagation means, which cooperate with the electron source and which are formed by ducts 6, 6', 6" etc., which are separated from the electron-propagation means by walls 11, 11', 11" etc., which extend at right angles to the rear wall 4 so as to form the ducts of a so-called duct structure. The electron-propagation means extend substantially parallel to the front wall and serve to transport the electrons emitted by the electron source through vacuum. In a plate 10, which closes the ducts 6, 6', 6" etc., apertures 7, 7', 7" etc. are provided for guiding electrons to the display screen. Said plate 10 may also comprise an assembly of various plates. In general, an addressing system for addressing desired pixels is provided between the duct structure and the front wall 3.

Figure 1B:
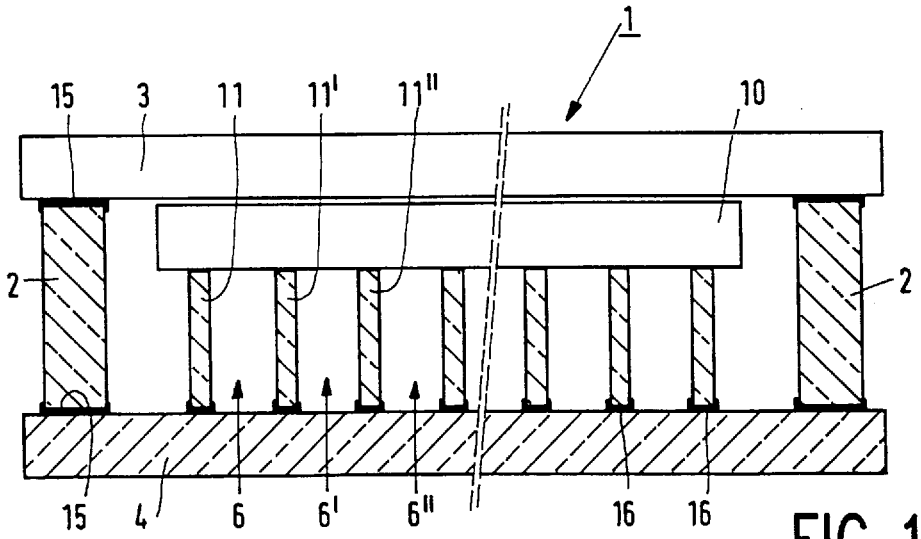
FIG. 1B shows, in cross-section, a plan view of the construction of FIG. 1A.

FIG. 1B schematically shows, in cross-section, a plan view of the construction of the thin-type display device 1 in accordance with the state of the art. The front wall (window) 3 and the rear wall 4 are spaced apart by the upright side walls 2 (the so-called spacer strips). The electron-propagation means cooperating with the electron source (not shown) are formed by the ducts 6, 6', 6" etc., which are separated from each other by walls 11, 11', 11" etc., which extend at right angles to the rear wall 4 so as to form the ducts of a so-called duct structure. Electrons are guided to the display screen via apertures (not shown) in plate 10. Plate 10 generally comprises an addressing system to address desired (luminescent) pixels and may also comprise, if desired, an assembly of various plates.

The side walls 2 are connected to the front wall 4 and the rear wall 3 by means of vacuum-tight connections 15 (using, for example, a suitable adhesive or a so-called (glass) frit). A disadvantage of the use of said connections 15 is that the walls may be inaccurately positioned relative to each other during the connecting process, which is undesirable. A further disadvantage of walls which are connected to the rear wall by means of a connection technique is that stresses may develop in these connections, while, in addition, undesirable properties of the material with which the walls of the ducts are connected to the rear wall, may adversely affect the quality (for example the service life) of the display device. A further disadvantage resides in that the connections 15 must seal the display device 1 in a vacuum-tight manner. The risk of undesirable leakage increases with the number of necessary connections 15.

The walls 11, 11', 11" etc. of the ducts of the duct structure are connected to the rear wall by means of connections 16. Alternatively, the walls 11, 11', 11" etc. may be mounted first on (and connected to) an auxiliary plate, whereafter said auxiliary plate, which is provided with the walls 11, 11', 11", etc. is positioned on the rear wall 3 and, if necessary, connected thereto. The use of an auxiliary plate on which the walls 11, 11', 11" etc. are provided has advantages if the material used for the walls 11, 11', 11" etc. differs from that used for the rear wall 4. A disadvantage of the use of the connections 16 is that inaccuracies in the positioning of the walls 11, 11', 11" etc. relative to each other may occur during the connecting operation, which is undesirable. This inaccuracy in the positioning of the walls 11, 11', 11" etc. causes the interspace between the walls 11, 11', 11" etc. and hence the width of the ducts of the duct structure extending (at right angles) to the rear wall 4 to be inconstant, which brings about differences in (beam) intensity between (in particular) adjacent propagation means, which differences in intensity give rise to annoying streaks in the image displayed on the display screen by the luminescent pixels.

Figure 2A:
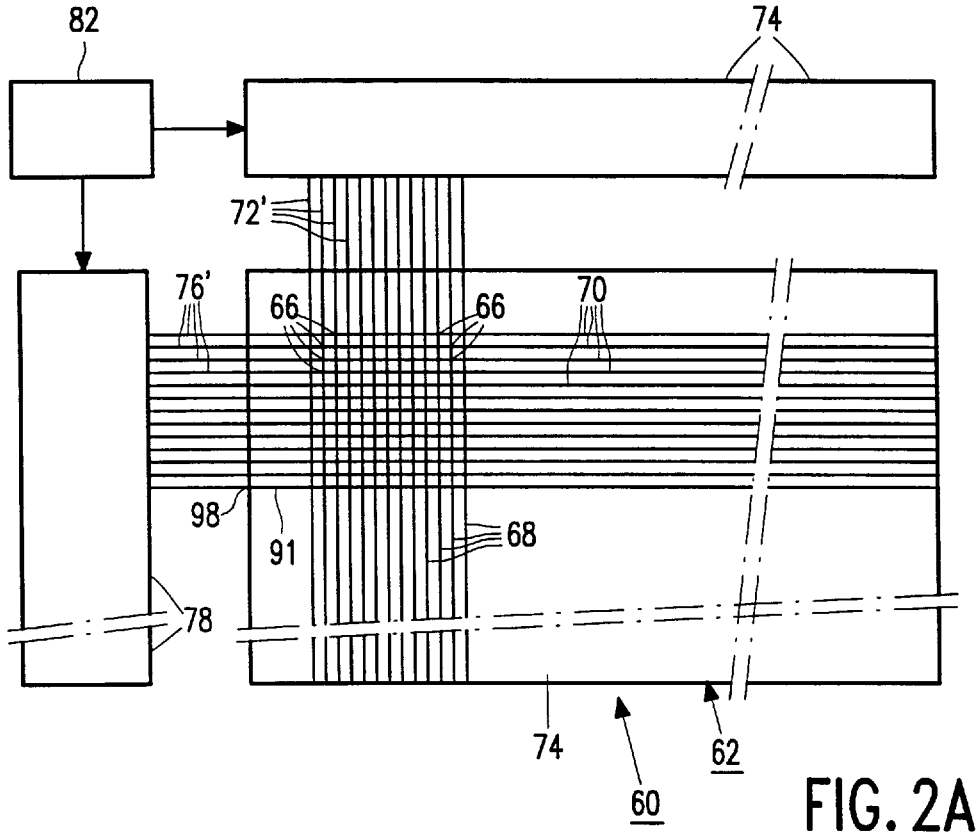
FIG. 2A is a schematic block diagram of a conventional flat panel display system.

FIG. 2A shows a flat panel display system 10, which represents a typical PALC display device and the operating electronic circuitry. with reference to FIG. 2A, the flat panel display system comprises a display panel 62 having a display surface 64 that contains a pattern formed by a rectangular planar array of nominally identical data storage of display elements 66 mutually spaced apart at predetermined distances in the vertical and horizontal directions. Each display element 66 in the array represents the overlapping portions of thin, narrow electrodes 68 arranged in vertical columns and elongate narrow channels 70 arranged in horizontal rows. (The electrodes 68 are hereinafter referred to from time to time as "column electrodes"). The display elements 66 in each of the row of channels represent one line of data.

The widths of column electrodes 68 and channels 70 determine the dimensions of display elements 66, which are typically rectangular shape. Column electrodes 68 are deposited on a major surface of a first electrically nonconductive, optically transparent substrate 84 (FIG. 2), and the channel rows are usually built into a second transparent substrate 86. Skilled persons will appreciate that certain systems, such as a reflective display of either the direct view or projection type, would require that only one substrate be optically transparent.

Column electrodes 68 receive data drive signals developed on output conductors 72' by different ones of output amplifiers 73 (FIG. 2B) of a data driver or drive circuit 74, and channels 70 receive data strobe signals developed on output conductors 76' by different ones of output amplifiers 71 (FIG. 2B) of a data strobe circuit 78. Between the channels walls 81 are present and at each side of a wall electrodes are present. Electrodes at opposite sides of a wall (and thus in adjacent channels) are electrically interconnected.

To synthesize an image on the entire area of the display surface 64, display systems 60 employs a scan control circuit 82 that coordinates the function of data drive 74 and data strobe 78 so that all columns of display elements 66 of display panel 62 are addressed row by row in, for instance, row scanning fashion.

Display panel 62 may employ electro-optical materials of different types. For example, if it uses such material that changes the polarization state of incident light rays, display panel 62 is positioned between a pair of light polarizing filters, which cooperate with display panel 62 to change the luminance of light propagating through them. The use of a scattering liquid crystal cell as the electro-optical material would not require the use of polarizing filters, however. All such materials or layers of materials which attenuate transmitted or reflected light in response to the voltage across it are referred to herein as electro-optic materials. As LC materials are presently the most common example, the detailed description will refer to LC materials but it will be understood that the invention is not limited thereto. A colour filter (not shown) may be positioned within display panel 62 to develop multi-coloured images of controllable colour intensity. For a projection display, colour can also be achieved by using three separate monochrome panels 62, each of which controls one primary colour.

Figure 2B:
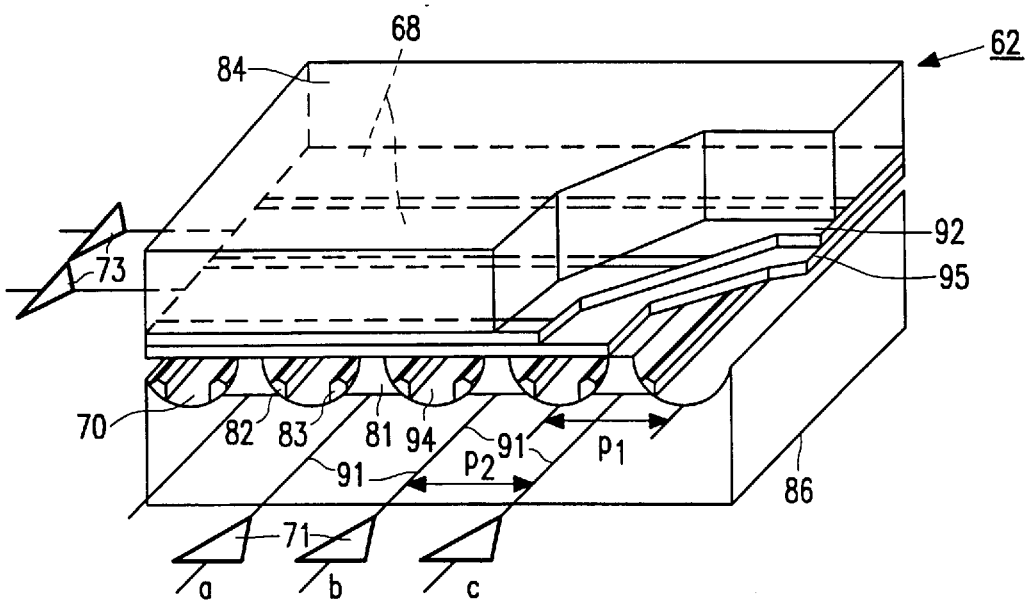
FIG. 2B is a perspective view of a part of a conventional PALC display device.

FIG. 2B illustrates the PALC version of such a flat display panel using LC material. Only 3 of the column electrodes 68 are shown. The row electrodes are constituted by a plurality of parallel elongated sealed channels 70 underlying a layer 92 of LC material. Each of the channels 70 is filled with an ionizable gas 94, closed off with a thin dielectric sheet 95 typically of glass, and contains on an interior channel surface first and second elongated electrodes 82 and 83. Electrodes at opposites sides of the wall 81 between channels are electrically interconnected. The interconnected electrodes have leads 91 through which pulses are supplied to the electrodes 82, 83. Supplying pulses as shown in FIG. 2 to the interconnected electrode will ignite channel 94 since the voltage difference between the electrodes in channel 94 is +V−(−V) where V is for instance 150 Volt=150−(−150) =300 Volt which is enough to form a plasma discharge. In neighbouring channels the voltage difference is 150 Volt which is not enough to form a plasma discharge. By choosing the proper pulses to be fed to the electrodes it is possible to form a plasma discharge in one and only one of the channels. The channels are filled with ionizable gas and thus form a gas-tight enclosure. (If this would not be the case, the channels would be contaminated with other gases or gas would leak out of the channels). The leads 91 are brought out from the gas-tight enclosure. As can be seen in FIG. 2A conventionally the leads are all parallel to each other and to the channels. In such an arrangement the pitch p2 of the leads equals the pitch p1 of the channels. At or near positions 98 where the leads 91 exit the gas-tight enclosure, there usually are made connectors to connect leads 71 to output conductors (which serve as supply lines) 76'.

Figure 3A:
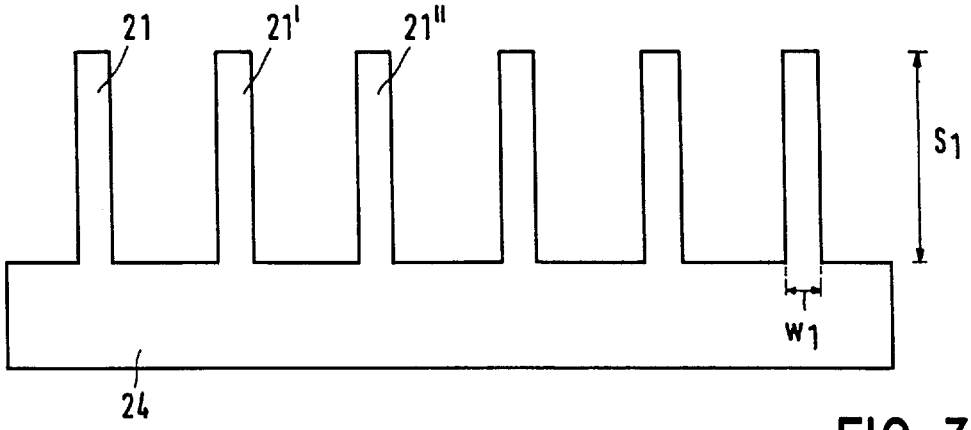
FIGS. 3A, 3B and 3C are cross-sectional views of embodiments of the rear wall and the walls of the ducts of the duct structure in accordance with the invention.

FIG. 3A is a schematic, cross-sectional view of an embodiment of the rear wall 24 and the walls 21, 21', 21" etc. of the ducts of the duct structure in accordance with the invention. The depth of the ducts and the width of the walls 21, 21', 21" etc. of the ducts of the duct structure (the ducts) are labeled $s_1$ and $w_1$ respectively, in FIG. 3A. In this example, the oppositely located faces of the walls 21, 21', 21" etc. extend parallel to each other. The rear wall 24 and the walls 21, 21', 21" etc. are in a single piece, that is the rear wall 24 and the walls 21, 21, 21" etc. are manufactured from a single, solid piece of one material, without the use of a connection technique. The advantages of such a construction are that connection techniques are superfluous, an accurate positioning of the walls 21, 21', 21" etc. on the rear wall is achieved, and that the number of parts of which the display device is built up is considerably reduced. In suitable methods of manufacturing the rear wall 24 and the walls 21, 21', 21" etc. of the electron-transport ducts in a single piece, transport ducts are formed in a substrate material by means of (selective) etching, sand blasting, grinding or pressing.

Figure 3B:
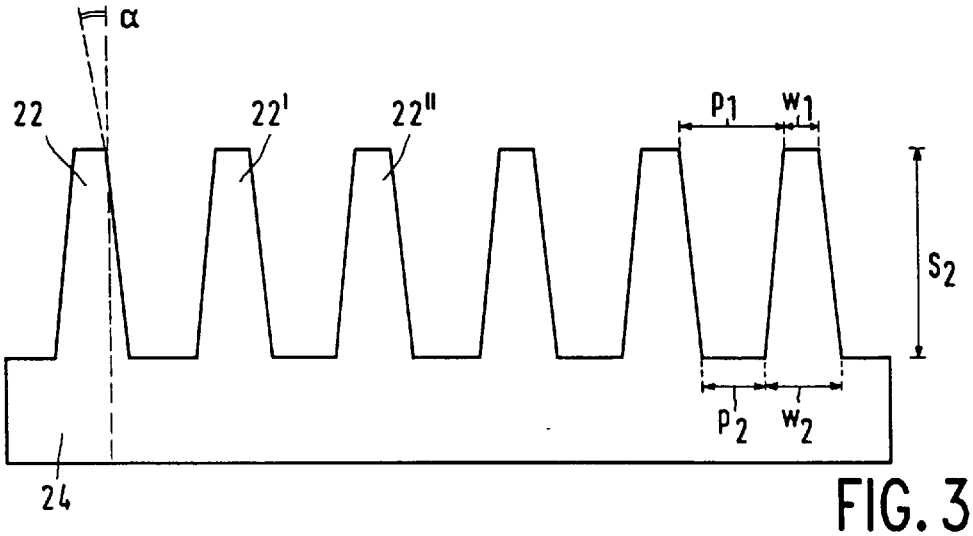

FIG. 3B is a schematic, sectional view of a preferred embodiment of the rear wall 24 and the walls 22, 22', 22" etc. of the ducts of the duct structure, said walls 22, 22', 22" etc. widening gradually in the direction of the rear wall 24. The depth of the ducts of the duct structure (the ducts) is labeled $s_2$ in FIG. 3B, said depth $s_2$ ranging preferably from 0.1 to 10 mm. In FIG. 3B, the width of and distance between the walls 22, 22', 22" etc. of the ducts, measured at the location of the portion of the walls 22, 22', 22" etc., which is (most) remote from the rear wall 24, are labeled $w_1$ and $p_1$ respectively, and the width of the walls 22, 22', 22" etc., measured at the location of the rear wall 24, is labeled $w_2$. Particularly if the ratio between $s_2$ and the width $w_1$ of the walls 22, 22', 22" etc. is greater than 2, in other words, if $$\frac{s_2}{w_1} \geqq 2$$

it is very important to strengthen the walls 22, 22', 22" etc. (at the base), i.e. widening of the walls 22, 22', 22" etc. in the direction of the rear wall 24 to preclude that the construction becomes too fragile.

The angle α, which opposing (side) faces of the walls 22, 22', 22" etc. make with the rear wall 24 is measured, as shown in FIG. 3B, at the location of the portion of the walls 22, 22', 22" etc. which is (most) remote from the rear wall 24. In the embodiment shown in FIG. 3B, the walls 22, 22', 22" etc. of the ducts widen in accordance with a straight line in the direction of the rear wall 24. The angle α suitably ranges between 1° and 30°, preferably between 3° and 10°.

A simple, geometric relation between the angle α, the depth $s_2$ of the walls 22, 22', 22" etc., the width $w_1$ of the walls 22, 22', 22" etc., measured at the location of the portion of the walls 22, 22', 22" etc., which is (most) remote from the rear wall 24, and the width $w_2$ of the walls 22, 22', 22" etc., measured at the location of the rear wall 24, can be derived, which relation can be expressed as follows:

$$\tan\alpha = \frac{w_2 - w_1}{2s_2}$$

If, for example, the angle α=3°, the depth $s_2$=5.0 mm and the width $w_1$=0.5 mm, then the width $w_2$=1.0 mm, that is the walls 22, 22', 22" etc. widen in the direction of the rear wall 24 by 0.5 mm. If the distance between the walls 22, 22', 22" etc., $p_1$=2.5 mm, the distance can be expressed, in this example, as $$p_2 = p_1 + w_1 - w_2 = 2{,}0 \text{ mm}$$

Figure 3C:
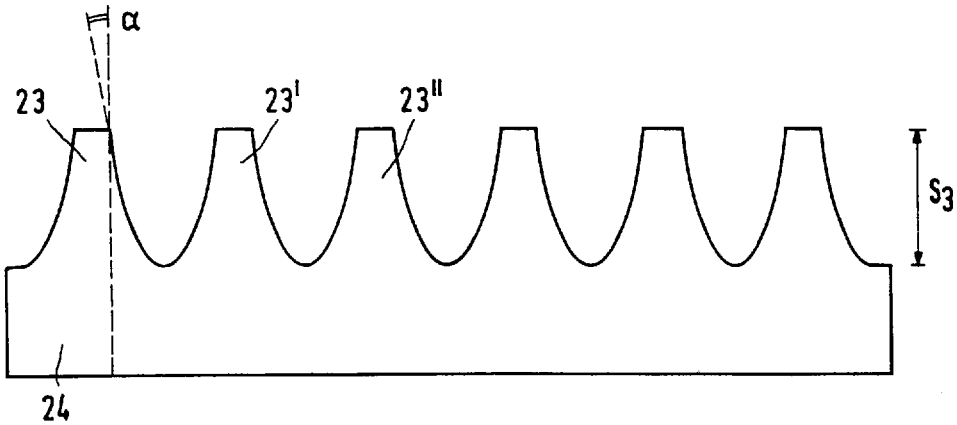

FIG. 3C is a schematic, sectional view of a preferred embodiment of the rear wall 24 and walls 23, 23', 23" etc. of the ducts of the duct structure, said walls 23, 23", 23" etc. widening gradually in the direction of the rear wall 24. The angle α, which opposing (side) faces of the walls 23, 23', 23" etc. make with the rear wall 24, is measured, as shown in FIG. 3C, at the location of the portion of the walls 23, 23', 23" etc., which is (most) remote from the rear wall 24. In the embodiment shown in FIG. 3C, the walls 23, 23', 23" etc. widen in accordance with a curved line in the direction of the rear wall 24. If the ducts of the duct structure become very shallow (see, for example, FIG. 3C), i.e. the depth is less than 1 mm measured relative to the rear wall 24, the angle α, which the walls 23, 23', 23" etc. make with the rear wall 24 can be greater than 30° (for example 60°).

A very suitable method of manufacturing the exemplary embodiments shown in FIGS. 3B and 3C, in which the rear wall 24 and the walls 22, 22', 22" etc. and 23, 23', 23" etc. of the ducts of the duct structure are manufactured in a single piece, and in which the walls 22, 22', 22" etc. and 23, 23', 23" etc. widen in the direction of the rear wall 24, consists in pressing ducts in a suitable substrate material (for example glass). The term "pressing" is to be understood to mean, on the one hand, the provision of a profiled structure (for example walls) in a quantity of glass, which may be unformed or pre-formed (for example a (flat) glass plate of the desired thickness) by a movement of a mould, and on the other hand, the provision of a profiled structure (for example walls) in a pre-formed (flat) glass plate by a (horizontal) movement of a mould (for example by means of rolling). The desired angle, which opposing faces of the walls make with the rear wall, is obtained by using a suitably chosen shape of the pressing member. In this manner, the desired structure is pressed in the substrate in a single process step. Other methods, such as (selective) etching, sand blasting and grinding are not always suitable for forming such well-defined profiles in the substrate.

Figure 4A:
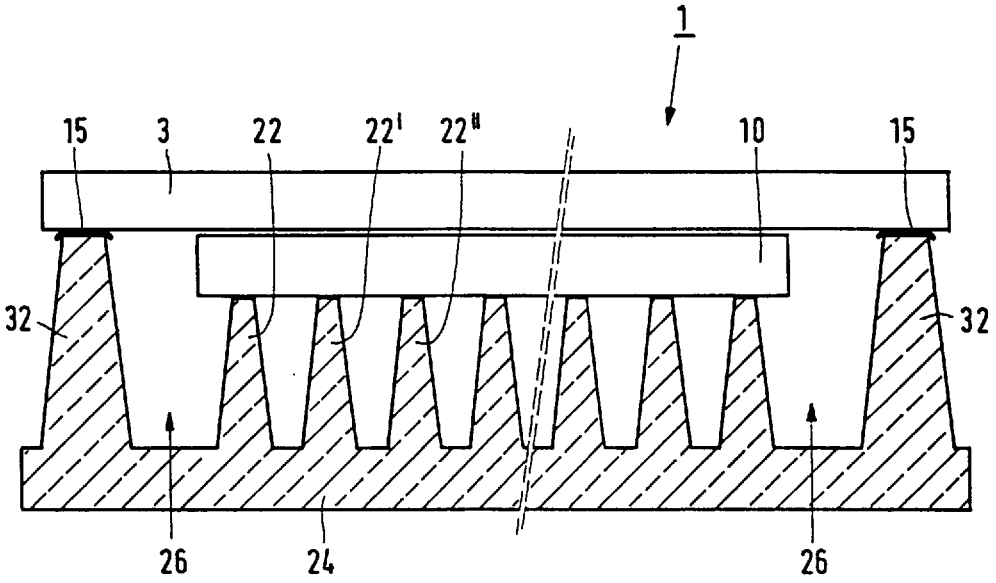
FIGS. 4A and 4B are cross-sectional views of embodiments of the thin-type display device in accordance with the invention.

FIG. 4A is a schematic, cross-sectional view of an embodiment of the thin-type display device 1 in accordance with the invention. Apart from the rear wall 24 and the walls 22, 22', 22" etc. of the ducts of the duct structure, in this embodiment, also the upright side walls 32 are manufactured in a single piece. This results in a further simplification of the manufacturing process of the display device 1. The upright side walls 32 may have side faces which extend perpendicularly to the rear wall, but they may alternatively (as shown in FIG. 4A) widen in the direction of the rear wall, i.e. they have bevelled side faces. A vacuum-tight connection 15 is provided only between the upright side walls 32 and the front wall 3, so that the risk of undesirable leakage is reduced considerably. As a result of the absence of a (vacuum-tight) connection between the side walls 32 and the rear wall 24, the positional accuracy of the display device is improved considerably. In accordance with FIG. 3B, the walls 22, 22', 22" etc. of the ducts of the duct structure widen in the direction of the rear wall 24.

Figure 4B:
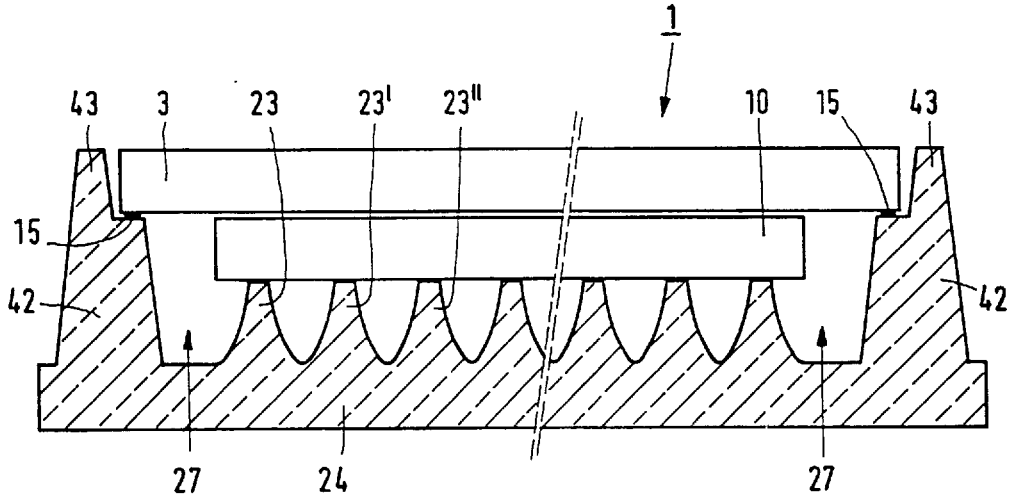

FIG. 4B is a schematic, cross-sectional view of an embodiment of the thin-type display device 1 in accordance with the invention. Apart from the rear wall 24 and the walls 23, 23', 23" etc. of the ducts of the duct structure, in this embodiment, also the upright side walls 42 having upright edges 43 are manufactured in a single piece. This results in a further simplification of the manufacturing process of the display device 1. In the embodiment of FIG. 4B, the upright side wall 42 is bevelled and provided with a (bevelled) upright edge 43 on the inside of which the front wall 3 is positioned. If desired, the edge 43 may extend beyond the front wall 3. If the edge 43 is provided with a further, projecting edge which extends parallel to the rear wall 24 (not shown in FIG. 4B), the projecting edge of the edge 43 can enclose the front wall 3 partly. If necessary, this can further increase the strength of the display device. A vacuum-tight connection 15 is provided only between the upright side walls 42 and the front wall 3, so that the risk of undesirable leakage is reduced considerably. The positional accuracy of the display device is improved considerably by the absence of a vacuum-tight connection between the side walls 32 and the rear wall 24. In accordance with FIG. 3B, the walls 22, 22', 22" etc. of the ducts of the duct structure widen in the direction of the rear wall 24.

A very suitable method of manufacturing the preferred embodiments shown in FIGS. 4A and 4B, in which the rear wall 24 and the walls 22, 22', 22" etc. and 23, 23', 23" etc. of the ducts of the duct structure and the upright side walls 32, and 42 and 43 are made in a single piece, and in which the walls 22, 22', 22" etc. and 23, 23', 23" etc. and the upright side walls 32, and 42 and 43 widen in the direction of the rear wall 24, consists in pressing the desired shapes (ducts) in a suitable substrate material (for example glass). If a pressing process is used for said construction, preferably, a glass is utilized whose temperature interval is less than 420° C., preferably less than 320°, between the operating temperature, at which $\eta=10^4$ dPa.s, and the softening temperature, at which $\eta=10^{7.6}$ dPa.s. Satisfactory results are obtained at an operating temperature of the glass above 1,050° C., preferably above 920° C. The coefficient of expansion of the material of the walls 22, 22', 22" preferably ranges from $35.10^{-7}$° to $50.10^{-7}$/° C., preferably from $40.10^{-7}$° to $45.10^{-7}$/° C. The rear wall and the side walls of the display device 1 are preferably made from the same material as the walls 22, 22', 22" of the ducts of the duct structure. Materials which can suitably be pressed into the desired shapes include borosilicate glass, borofloate glass and soda-lime glass. In the case of plasma displays and plasma-addressed LCDs, a further preferred material for pressing into the desired shapes is lead glass. Lead glass yields good results at an operating temperature of the glass of 1,000° C. and higher.

Preferably, a space 26, 27 for holding further elements of the display device is present in said display device 1 between the side wall 32, 42 and the walls 22, 22', 22" etc. and 23, 23', 23" etc. of the ducts of the duct structure. Elements which can be accommodated in said space 26, 27 are, for example, the electron source, a getter, wiring for driving (the ducts of) the duct structure and for the addressing system for addressing desired pixels, as well as an exhaust tube.

In a particularly preferred embodiment of the display device in accordance with the invention, the rear wall, the duct structure and, if necessary, the upright side walls are manufactured in a single piece, preferably of glass, which is shaped by means of a pressing process. In the case of thin-type display devices having standard picture dimensions (for example a length-width ratio of 3:4, 9:16, 10:16 or 9:21) and comprising a (vertically) arranged duct structure, the length of the ducts of the duct structure ranges from 50 to 750 mm, and the depth of the ducts of the duct structure ranges between 2 and 10 mm, the (average) thickness of the walls of the ducts of the duct structure ranges between 0.1 and 5 mm, and the distance between the ducts of the duct structure (the so-called "pitch") preferably ranges between 1 and 10 mm. In plasma displays and plasma-addressed LCDs, the depth of the duct structure ranges between 0.1 and 0.5 mm.

It will be obvious that within the scope of the invention many variations are possible to those skilled in the art.

In general, the invention relates to a thin-type display device comprising a transparent front wall, which is provided with a display screen, and a rear wall which extends parallel to said front wall, and comprising at least an electron source and a duct structure. The display device is characterized in that the rear wall and walls of the ducts of the duct structure are manufactured in a single piece. Preferably, the walls of the ducts widen in the direction of the rear wall, with the angle, which opposing faces of the walls make with each other, ranging from 1° to 30°. Preferably, the rear wall further comprises at least an upright side wall which is integral with the rear wall. Preferably, the walls are manufactured from a glass having a temperature interval of less than 420°, preferably less than 360° between the operating temperature and the softening temperature; and the rear wall with the duct structure and the side walls can be pressed in one process step.

We claim:

1. A thin-type display device which comprises a transparent front wall which is provided with a display screen having a pattern of pixels, and a rear wall which extends parallel to said front wall, which display device includes at least an electron source and a duct structure comprising ducts, which cooperates with said electron source and extends substantially parallel to the front wall, and which comprises duct walls which are transverse to the rear wall, said rear wall and the duct walls forming the ducts of the duct structure, the rear wall and the duct walls of the ducts of the duct structure being constructed in one piece, the one piece further comprising at least an upright side wall to obtain a vacuum-tight connection between the front wall and the rear wall.

2. A display device as claimed in claim 1, characterized in that the walls of the ducts of the duct structure widen in the direction of the rear wall, opposing faces of the walls of the ducts making an angle with a normal, the normal extending perpendicularly to the rear wall, the angel ranging from 1° to 30°.

3. A display device as claimed in claim 2, in which the angle ranges from 3° to 10°.

4. A display device (1) as claimed in claim 1, in which the depth of the ducts of the duct structure, measured in a direction perpendicular to the rear wall, ranges from 0.1 to 10 mm.

5. A display device as claimed in claim 1, in which the glass of the walls comprises a borosilicate glass or a soda-lime glass.

6. A display device as claimed in claim 1, in which the side wall, viewed from the rear wall, extends beyond the walls of the ducts of the duct structure.

7. A display device as claimed in claim 1, in which the side wall further comprises an upright edge on the inside of which the front wall is positioned.

8. A display device as claimed in claim 1, a space for holding further elements of the display device is present between the side wall and the walls of the ducts of the duct structure.

9. A display device as claimed in claim 1, characterized in that the walls are made from a glass having a temperature interval of less than 420° C. between the operating temperature and the softening temperature.

10. a display device (1) as claimed in claim 9, in which operating temperature of the glass is higher than 920° C.

11. a display device as claimed in claim 10, in which operating temperature of the glass is higher than 1.050° C.

12. A display device as claimed in claim 9, characterized in that the walls are made from a glass having a temperature interval of less than 360° C., between the operating temperature and the softening temperature.

13. A display device as claimed in claim 1 in which the rear wall and the walls of the ducts are constructed of material whose coefficients of expansion ranges from $35\times10^{-7}$/° C. to $50\times10^{-7}$/° C.

14. A display device as claimed in claim 13, in which the rear wall and the walls of the ducts are constructed of materials whose coefficients of expansion range from $40\times10^{-7}$ to $45\times10^{-7}$/° C.

* * * * *